US008753565B2

(12) United States Patent
Caballero Oguiza

(10) Patent No.: US 8,753,565 B2
(45) Date of Patent: Jun. 17, 2014

(54) HADFIELD STEEL

(75) Inventor: Patricia Caballero Oguiza, San Sebastián (ES)

(73) Assignee: Fundacion Tecnalia Research & Innovation (ES)

( * ) Notice: Subject to any disclaimer, the term of this patent is extended or adjusted under 35 U.S.C. 154(b) by 29 days.

(21) Appl. No.: 13/325,223

(22) Filed: Dec. 14, 2011

(65) Prior Publication Data

US 2012/0145286 A1 Jun. 14, 2012

(30) Foreign Application Priority Data

Dec. 14, 2010 (EP) ..... 10382335

(51) Int. Cl.
*C22C 38/04* (2006.01)

(52) U.S. Cl.
USPC ..... 420/72

(58) Field of Classification Search
CPC ..... C22C 38/04
USPC ..... 420/72–76, 99, 44–48, 56; 148/329, 148/619, 620
See application file for complete search history.

(56) References Cited

U.S. PATENT DOCUMENTS 4,875,933 A * 10/1989 Wan ..... 75/10.17
5,308,408 A * 5/1994 Katila ..... 148/328

FOREIGN PATENT DOCUMENTS

GB 741935 A 12/1955
JP 57203748 A 12/1982
RU 2326985 C1 6/2008
RU 2327798 C1 6/2008
SU 1507846 A1 9/1989

OTHER PUBLICATIONS

English abstract of SU 1507846 A, Anufriev et al., Sep. 15, 1989.*
English translation of SU 1507846 A , Anufriev et al., Sep. 15, 1989.*
ASMT A 128/A 128M-84; Steel Castings, Austenitic Manganese; Published Nov. 1984; 2 pages.
ASTM E112-10; Determining Average Grain Size; Jan. 17, 2006; 26 pages.
ASTM E 112-96e2; Standard Test Methods for Determining Average Grain Size; Published Jul. 1996; 26 pages.
Austenitic Manganese Steel Castings; in Metals Handbook, Ninth Edition, vol. 9, Metallography and Microstructures; George Vander Voort, Ed.; published 1992; p. 241.
ISO 643:2003; Steels—Micrographic Determination of the Apparent Grain Size; with English Abstract; Stage: 95.99 (Dec. 10, 2012); Abstract printed Oct. 23, 2013; 45 pages.
European Standard prEN 15689:2007:E, draft, Railway Applications—Track—Switches and Crossings—Cast Austenitic Manganese Steel for Crossing Components; Jun. 2007; 18 pages.

* cited by examiner

*Primary Examiner* — Deborah Yee
(74) *Attorney, Agent, or Firm* — Cantor Colburn LLP

(57) ABSTRACT

Hadfield steel and a method for obtaining the same, which steel has better mechanical properties than basic Hadfield steel, without detriment to any of them, which has a homogenous grain size distribution, thus allowing new applications, having the following chemical composition:

0.90 to 1.35% by weight of C,
11.00 to 14.00% by weight of Mn,
0.80% maximum by weight of Si,
0.07% maximum by weight of P,
0.05% maximum by weight of S and
an amount of hafnium greater than or equal to 0.01% and less than 0.1% by weight, the rest being iron and impurities associated with iron, and where the percentages are expressed by weight with respect to the total weight of the steel.

1 Claim, 2 Drawing Sheets

HADFIELD STEEL

TECHNICAL FIELD OF THE INVENTION

The present invention is encompassed in the sector of the metallurgical industry and more specifically it relates to Hadfield steel.

BACKGROUND OF THE INVENTION

The so-called Hadfield steels or manganese steels owe their names to their British inventor, Sir Robert Hadfield in 1882, and are basically characterized by comprising an amount of manganese usually above 11% by weight, the ratio between carbon and manganese also being adjusted, such that the ratio by weight of manganese is usually in an order of eleven times the weight of carbon. These steels usually comprise 0.8-1.25% of carbon and 11-15% of manganese by weight in their basic composition.

Hadfield steels have a high impact strength and resistance to abrasion.

Hadfield steel reaches its properties of maximum hardness and ductility at about 12% by weight of manganese values.

These steels are non-magnetic and with low conductivity having the peculiarity that, among others, their impact performance improves with cold working. In this sense, the hardness of these steels increases up to three times the initial hardness after working under impact, which confers them a special usefulness for use thereof in determined applications, such as for example manufacturing of railway crossings, quarry parts or parts for cement manufacturing plants and in numerous applications in the scope of primary industry, such as in mining.

The manganese steels known as Hadfield steels have an elemental chemical composition which, according to the recommendations of the standard usually followed for the manufacture thereof, the United States ASTM A 128 standard, which are also found in the European prEN-15689-2007-ING standard, have the following basic chemical composition:

Carbon: 0.90 to 1.35%
Manganese: 11.00 to 14.00%
Silicon: 0.8% maximum
Phosphorus: 0.07% maximum
Sulphur: 0.05% maximum The starting hardness of this material is from 190 to 220 HB after a sudden and extreme quenching treatment at 1050° C., obtaining, according to prEN-15689-2007-ING standard, a greater tensile strength from 700 to 800 MPa, an elongation between 10 to 35%, a yield stress between 320 to 400 MPa and a resilience between 50 and 160 J.

As a general rule, the manganese content is not usually less than, and should not be much greater than, 11.00% given that in these cases, the wear resistance improves but ductility is seriously compromised. Furthermore, by exceeding this proportion, the price of the manufactured material is increased without significantly improving its mechanical characteristics. It is acknowledged that the suitable properties are obtained with a composition of 1.20% of C and 12.50% of Mn.

The existence of Hadfield steels which incorporate alloy elements such as V, Cr, Mo, Ti, Nb, N or Ce for the purpose of improving some of its properties is presently known. However, improving some of them is achieved to the detriment of another. Furthermore, these alloyed Hadfield steels usually have residual stresses greater than those of a conventional Hadfield steel since the additions cause changes in the crystallographic structure of the steel.

As is seen in Table 1, the addition of alloy elements generally entails an improvement of some of the mechanical properties.

TABLE 1

Mechanical properties of different Hadfield steels tested according to the prEN-15689-2007-ING standard.

| Material | Tensile strength (MPa) | Yield stress (MPa) | Elongation (%) | Resilience (J) | Hardness (HB) |
|---|---|---|---|---|---|
| Basic Hadfield | 700-800 | 320-400 | 10-35 | 50-160 | 190-220 |
| Basic Hadfield + Mo, Ti addition | 730-800 | 340-370 | 25-40 | 60-140 | 210-230 |
| Basic Hadfield + Nb, Ti addition | 730-820 | 350-390 | 30-45 | 60-140 | 210-250 |
| Basic Hadfield + V, Ti addition | 740-830 | 350-390 | 30-45 | 70-160 | 210-260 |
| Basic Hadfield + Ce addition | 770-880 | 350-400 | 30-45 | 70-160 | 210-230 |

The microstructure and particularly the grain size are associated with the mechanical properties. A smaller and more homogenous grain size is an indicator of improved mechanical characteristics.

The basic microstructure of ASTM A128 grade A Hadfield steel is determined according to "Metals Handbook". 9th Edition. Volume 9. Metallography and Microstructures, pages 240 and 241".

With respect to the basic microstructure, the basic microstructure shown in FIG. 1 presents a reduction of the grain size especially in the priority cooling areas. Nevertheless, this reduction of grain size is not seen in the entire microstructure of the part.

The homogeneity of the grain size is related with the improvement of the mechanical properties. Therefore it would be desirable to have a Hadfield steel in which all its mechanical properties are optimized and its microstructure is austenitic and is as homogenous as possible in grain size.

In this sense, an improvement of the material in this aspect would open up the range of applications of Hadfield, therefore reducing its limitations.

Therefore, improving the Hadfield material is required because the current requirements are more demanding as they call for better performances of the parts in industrial applications which were not previously used or required.

Likewise, Japanese patent no. JP-57-203748-A is known, which describes a composition corresponding to a Hadfield steel that incorporates Hf in its composition, but in high percentages (between 0.1 and 2.5% by weight of the composition) which allow, by means of applying focused heat source (laser, source of electrons, ultraviolet) obtaining magnetized areas in the material, i.e., it is not related with the improvement in the mechanical properties of the Hadfield steel.

BRIEF SUMMARY OF THE INVENTION

The invention obtains an improved Hadfield steel which has better mechanical properties than a basic Hadfield steel, without detriment to any of them, thus allowing new applications, such as for example in the scope of the transport industry or in electromagnetic applications.

To that end, a first aspect of the invention relates to a Hadfield steel that is based on the addition of hafnium as an alloy element, conferring to the resulting material a homogenous grain size distribution and therefore improved mechanical properties.

The Hadfield steel of the invention has the following chemical composition:

0.90 to 1.35% by weight of C, 11.00 to 14.00% by weight of Mn, 0.80% maximum by weight of Si, 0.07% maximum by weight of P, 0.05% maximum by weight of S and an amount of hafnium greater than or equal to 0.01% and less than 0.1% by weight, the rest being Fe and impurities associated with iron and where the percentages are expressed by weight with respect to the total weight of the steel.

Likewise, the addition of hafnium does not affect the stress state of the crystalline structure of the basic Hadfield steel, contrary to what occurs by means of the additions of other elements such as V, Cr, Mo, Ti, Nb or Ce in the same proportion. This can be seen in FIG. 3, in which the residual stresses of different Hadfield steels have been depicted.

A second aspect of the invention relates to a process for obtaining said Hadfield steel, which is performed by means of liquid metallurgy followed by a heat treatment for dissolving the generated carbides.

The addition of hafnium can be directly performed by depositing it in the molds, in the casting ladle, or in the jet while it is being cast in the mold or by compressing the hafnium into tablets that are housed in the sprue of the mold entrance.

DETAILED DESCRIPTION

A preferred embodiment of the Hadfield steel of the invention has the following composition by weight:

Carbon: 1.2%

Silicon: 0.5%

Manganese: 12.5%

Sulphur: <0.03%

Phosphorus: <0.05%

Hafnium: 0.05%

The Hadfield steel of the invention has a set of improved mechanical properties in relation to those indicated in table 1 for a conventional Hadfield steel. These mechanical properties are shown in Table 2.

TABLE 2

Mechanical properties of the Hadfield steel according to an example of the invention in accordance with the prEN-15689-2007-ING standard.

| Material | Tensile strength (MPa) | Yield stress (MPa) | Elongation (%) | Resilience (J) | Hardness (HB) |
|---|---|---|---|---|---|
| Basic Hadfield + Hf addition | 950 | 390 | 49 | 160 | 220 |

The Hadfield steel with hafnium of the invention has a good combination of strength and ductility, is very tough and furthermore has an extraordinary elongation of 49%.

Figure 2:
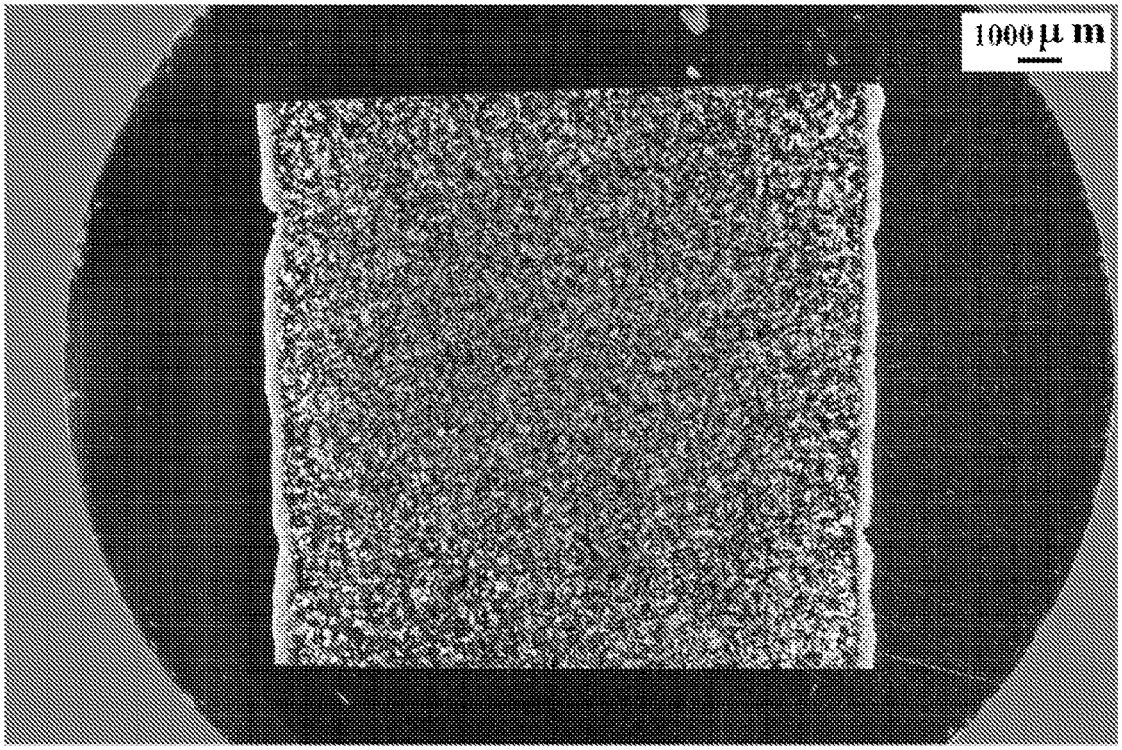
FIG. 2 shows a detail of the microstructure of a basic Hadfield steel with hafnium.

As can be seen in FIG. 2, the microstructure of the Hadfield steel alloy with hafnium has an austenitic structure with slightly marked grain boundaries, which indicates a good carbide dissolution and a homogenous grain size of grade 5/6 according to the UNE-EN ISO 643 and ASTM E-112 standards, homogenously distributed throughout the entire part.

Figure 1:
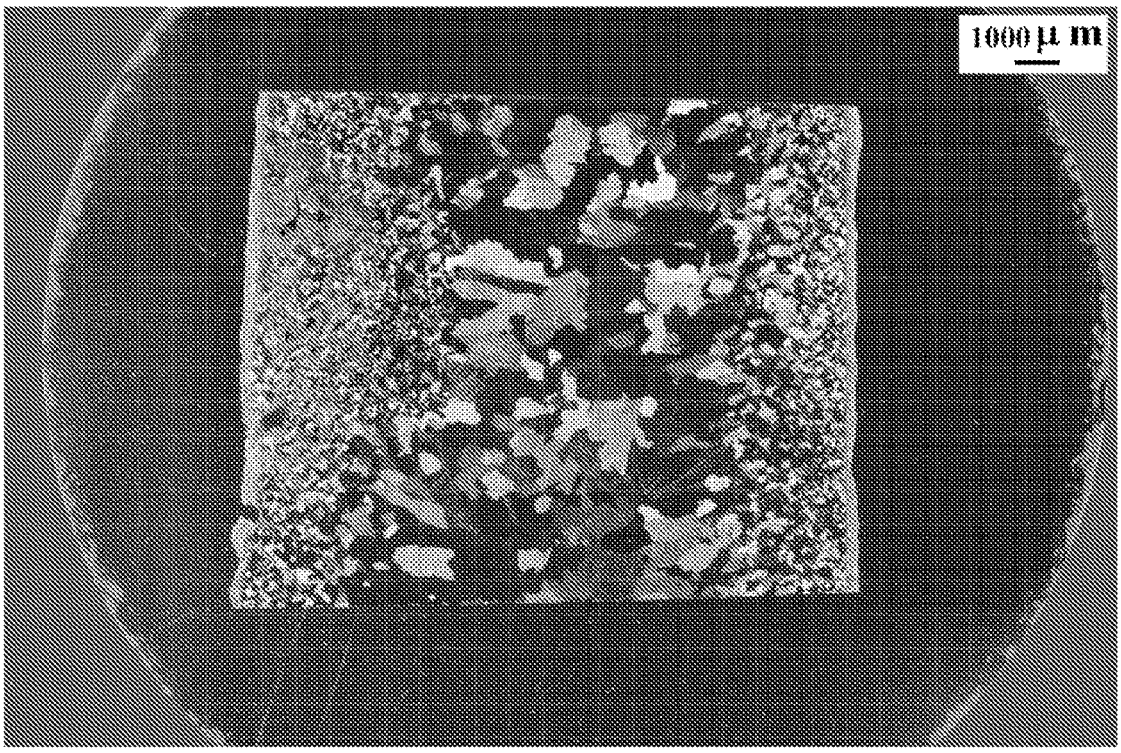
FIG. 1 shows a detail of the microstructure of a basic Hadfield steel with cerium.

In comparison with the microstructure of the Hadfield steel alloyed with cerium shown in FIG. 1, the Hadfield steel of the invention has a more homogenous grain size distribution throughout the entire part.

Figure 3:
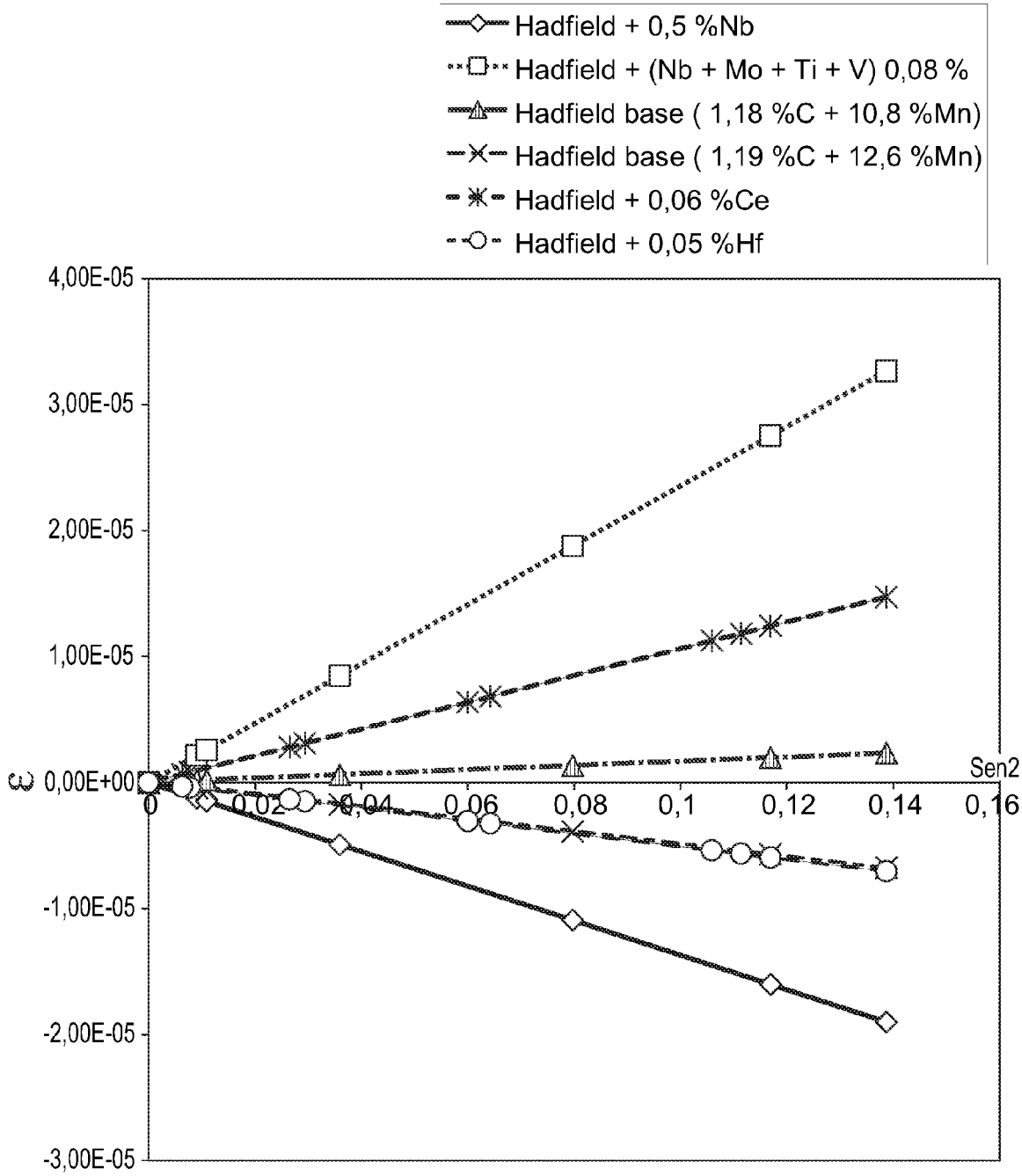
FIG. 3 shows a graph in which residual stresses of different Hadfield steels have been depicted.

FIG. 3 shows the residual stresses measured by X-ray diffractometry for the different alloyed Hadfield steels as described above, both for the example according to the invention and the alloyed Hadfield steels described in Table 1. The values obtained for the steel of this invention are very similar to those obtained for the basic Hadfield steel and less than those described above. The different stresses are represented by the slope of the straight line that represents each steel.

According to a preferred embodiment, hafnium (Hf) is added in the form of powder with a grain size of −60+325 mesh in the mold. In a preferred embodiment, 5 grams of hafnium, i.e., 0.05% by weight of Hf, are added for a 1 kg part.

The dissolution of the hafnium microparticles in the basic melt is aided. Said dissolution is favored by stirring the basic melt by means of a mechanical element. The purpose of said stirring is to achieve complete "wettability" of the alloying material as well as a homogenous distribution thereof within the liquid melt.

Finally, a heat treatment process adjusted for dissolving the carbides in the grain boundary is applied to the material obtained according to the previously described method. Said heat treatment comprises, once a part is cooled after being cast, introducing said part in the treating oven at room temperature and gradually reaching up to an approximate temperature of 1100° C., where it is maintained for an hour and a half for every 25 mm of thickness of the part to be treated. Once this time has elapsed, it is rapidly cooled in less than 60 seconds by introducing it in water at less than 30° C.

The invention claimed is:

1. Hadfield steel, consisting essentially of:

0.90 to 1.35% by weight of C, 11.00 to 14.00% by weight of Mn, 0.80% maximum by weight of Si, 0.07% maximum by weight of P, 0.05% maximum by weight of S and an amount of hafnium greater than or equal to 0.01% and less than 0.1% by weight, the rest being iron and impurities associated with iron, and wherein the percentages are expressed by weight with respect to the total weight of the steel.

* * * * *